US006983118B2

(12) United States Patent
Jaskowiak et al.

(10) Patent No.: US 6,983,118 B2
(45) Date of Patent: Jan. 3, 2006

(54) THIN WALLED FUSER ROLL WITH STRESS REDIRECTED FROM AXIAL TO RADIAL DIRECTION

(75) Inventors: Timothy R. Jaskowiak, Webster, NY (US); James A. Herley, Chesapeake, VA (US); Linda Gail Price, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 98 days.

(21) Appl. No.: 10/737,456

(22) Filed: Dec. 16, 2003

(65) Prior Publication Data

US 2005/0129433 A1 Jun. 16, 2005

(51) Int. Cl.
*G03G 15/20* (2006.01)

(52) U.S. Cl. ..... 399/330; 399/320; 399/328

(58) Field of Classification Search ..... 399/167, 399/320, 328, 329, 330, 331, 333, 338; 219/216; 347/156

See application file for complete search history.

(56) References Cited

U.S. PATENT DOCUMENTS

| | | | | |
|---|---|---|---|---|
| 4,975,743 | A * | 12/1990 | Surti | 399/167 X |
| 5,184,952 | A * | 2/1993 | Nishikawa et al. | 219/216 X |
| 5,659,848 | A * | 8/1997 | Jeon | 399/330 X |
| 5,687,297 | A | 11/1997 | Coonan et al. | 395/102 |
| 5,768,673 | A * | 6/1998 | Morigami | 399/330 |
| 5,937,241 | A * | 8/1999 | Kumar et al. | 399/167 X |
| 6,069,624 | A | 5/2000 | Dash et al. | 345/333 |
| 6,393,248 | B1 * | 5/2002 | Tsurusaki et al. | 399/330 |
| 6,485,878 | B2 * | 11/2002 | Nagase et al. | 399/330 X |
| 6,490,429 | B2 * | 12/2002 | Okayasu et al. | 399/328 |
| 6,628,916 | B2 * | 9/2003 | Yasui et al. | 399/329 |
| 6,636,709 | B2 * | 10/2003 | Furukawa et al. | 399/329 X |

* cited by examiner

*Primary Examiner*—Sandra L. Brase
(74) *Attorney, Agent, or Firm*—Richard Spooner

(57) ABSTRACT

A thin-walled fuser roll core cylinder assembly permitting fast warm-up times and improved energy efficiency wherein cracking of the thin walls of the core cylinder due to cyclic compression is prevented by redirecting axial stress at the terminus of an axial keyway to a radial direction. The keyway is for coupling the core cylinder to a drive gear. Use of such a thin-walled fuser roll in an imaging system and a process of fusing toner onto a copy substrate using the thin-walled fuser core.

22 Claims, 8 Drawing Sheets

THIN WALLED FUSER ROLL WITH STRESS REDIRECTED FROM AXIAL TO RADIAL DIRECTION

CROSS-REFERENCE TO RELATED APPLICATIONS

Reference is made to commonly-assigned copending U.S. patent application Ser. No. 10/736,961 filed Dec. 16, 2003, entitled "THIN WALLED FUSER ROLL WITH STRENGTHENED KEYWAY", by Timothy R. Jaskowiak, et al., the disclosure of which is incorporated herein.

BACKGROUND AND SUMMARY

Fuser rolls used in electrostatographic imaging systems generally comprise a metal core cylinder coated with one or more elastomer layers. Conventional fuser roll core cylinders are relatively thick walled aluminum alloy cylinders. Such thickness has been desired in order to provide strength and durability as the fuser roll presses against the nip of the adjoining compression roll. For a 35.00 mm outside diameter fuser roll core, a thickness of 5.5 mm is fairly standard. Similar dimensions are common in office and production printing systems capable of imaging more than 50 pages per minute. One drawback to such relative thickness is that thicker walls make the cylinder more massive. Since a typical fuser must attain a fusing temperature of approximately 150 C, significant power and time are required to heat and maintain the fuser at fusing temperatures. For conventional fuser cores of about 5.5 mm thickness, warm-up time lasts from about 7 to about 30 minutes.

In order to save energy and to shorten warm-up times, it would be desirable to reduce the wall thickness of fuser cylinder cores as much as possible. Experience indicates, however, that simply thinning cylinder walls creates problems in the end region of the cylinder. In particular, weakness and cracking results at the end if conventional drive slots are machined into the fuser core cylinders. Drive slots are used as part of the system to rotate fuser cylinder cores. As shown in FIG. 1, rotation is generally caused by mating a core cylinder 10 snugly with a drive gear 11. Mating occurs by driving key 15 into slot 14. Because heating lamps need to be inserted into the fuser roll core subsequent to mating of drive gear 11 to cylinder 10, the inside diameter of drive gear 11 forms a sleeve 12 that slips over core cylinder 10 in the manner shown. Key pin 15 protrudes inwardly from sleeve 12 to engage slot 12. Another reason that sleeve 14 slips over cylinder 10 rather than into cylinder 10 is that drive gear 11, together with sleeve 12, is generally made of rigid plastic. Such plastic has a different co-efficient of expansion than the metal of cylinder 10. Thus, if sleeve 12 protruded inside of cylinder 10, the metal of cylinder 10 would expand at a rate greater than the plastic of drive gear 11 during fusing and thereby create undesirable looseness between drive gear 11 and cylinder 10.

It would be desirable to produce a durable thin-walled core fuser cylinder that enables energy efficiency and fast warm-up times while meeting or exceeding specifications for durability and imaging performance.

One embodiment of a thin-walled fuser roll assembly of the present invention is a thin-walled fuser roll core assembly, comprising: a metallic core cylinder having a wall thickness between about 0.5 millimeters and about 2.0 millimeters, an end region, and having an axial and a radial direction; a drive gear having an internal diameter sleeve for fitting over an end of the core cylinder and a key for forcing rotation of the core cylinder; a keyway in the end region of the core cylinder for receiving the drive gear key, said keyway having a terminus; a means for redirecting axial oriented stress at the terminus of the keyway to a radial direction.

Another embodiment of the present invention is an electrostatographic imaging system, comprising: a thin-walled fuser roll assembly, comprising: a metallic core cylinder having a wall thickness between about 0.5 millimeters and about 2.0 millimeters, an end region, and having an axial and a radial direction; a drive gear having an internal diameter sleeve for fitting over an end of the core cylinder and a key for forcing rotation of the core cylinder; a keyway in the end region of the core cylinder for receiving the drive gear key, said key way having a terminus; a means for redirecting axial oriented stress at the terminus of the keyway to a radial direction.

Yet another embodiment of the present invention is a process for fusing toner to a copy sheet, comprising: for a period less than about one (1) minute, pre-heating a thin-walled fuser roll comprising core cylinder walls between about 0.5 millimeters and about 2.0 millimeters thick wherein a redirecting means redirects axial oriented stress at the terminus of an axial keyway formed in the thin walls to a radial direction; moving a copy sheet into engagement with a nip formed by the fuser roll and a pressure roll; and driving rotation of the fuser roll with a drive gear having an internal diameter sleeve fitting over an end of the core cylinder and a key for engaging the keyway of the core cylinder, thereby moving the paper through the nip.

DETAILED DESCRIPTION

Figure 1:
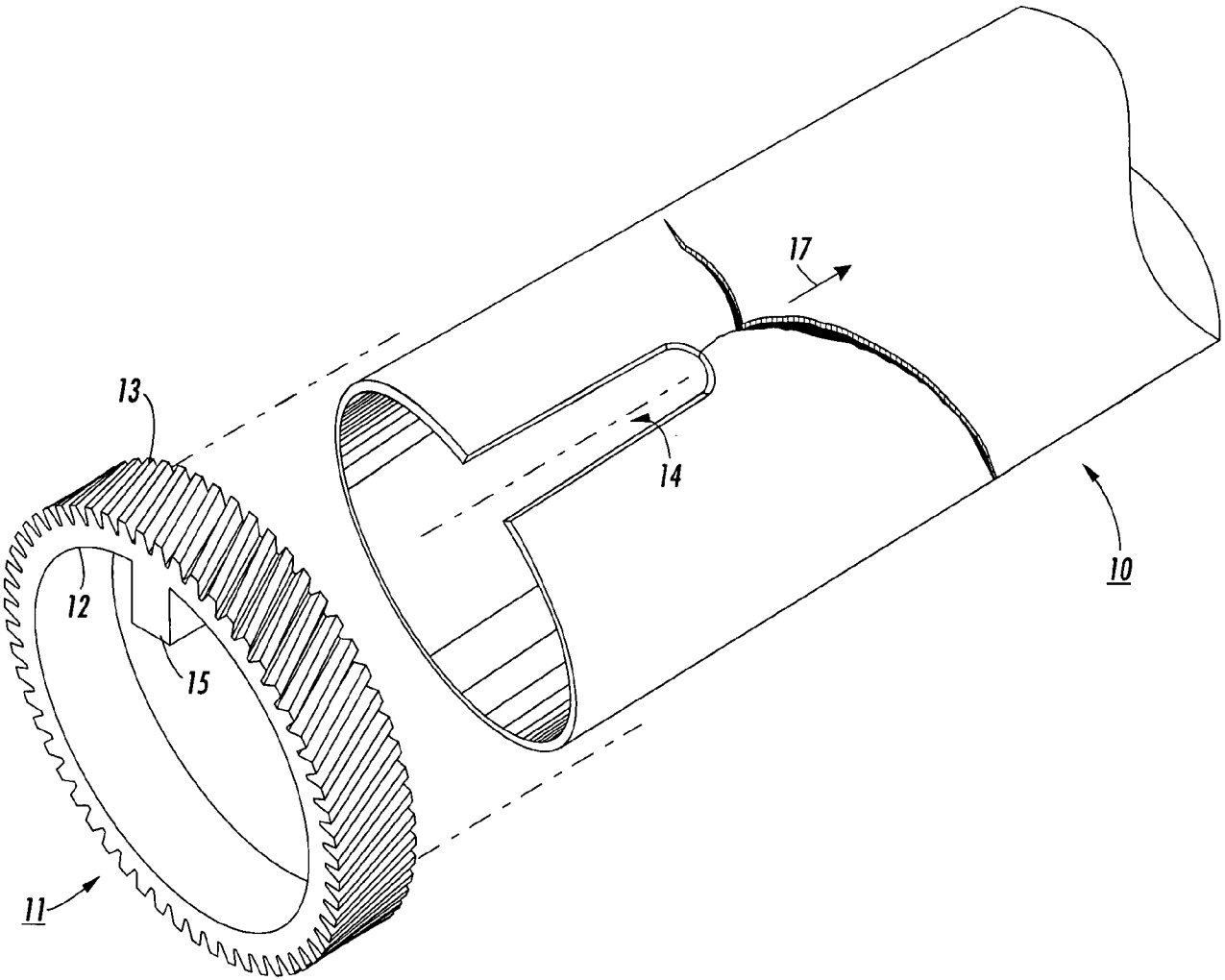
FIG. 1 PRIOR ART
FIG. 1 is a perspective view of thin-walled fuser roll core cylinder assembly showing the failure mode of such an assembly without the strengthening of the present invention.

For a general understanding of the present invention, reference is made to the drawings. In the drawings, like reference numerals have been used throughout to designate identical elements.

An exemplary electronic system comprising one embodiment of the present invention is a multifunctional printer with print, copy, scan, and fax services. Such multifunctional printers are well known in the art and may comprise print engines based upon ink jet, electrophotography, and other imaging devices. The general principles of electrophotographic imaging are well known to many skilled in the art.

Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. Permanent fixation generally is accomplished by fusing the developing material, or toner, to the support substrate using heat and pressure. Fuser rolls of the present invention are used in this process. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Figure 8:
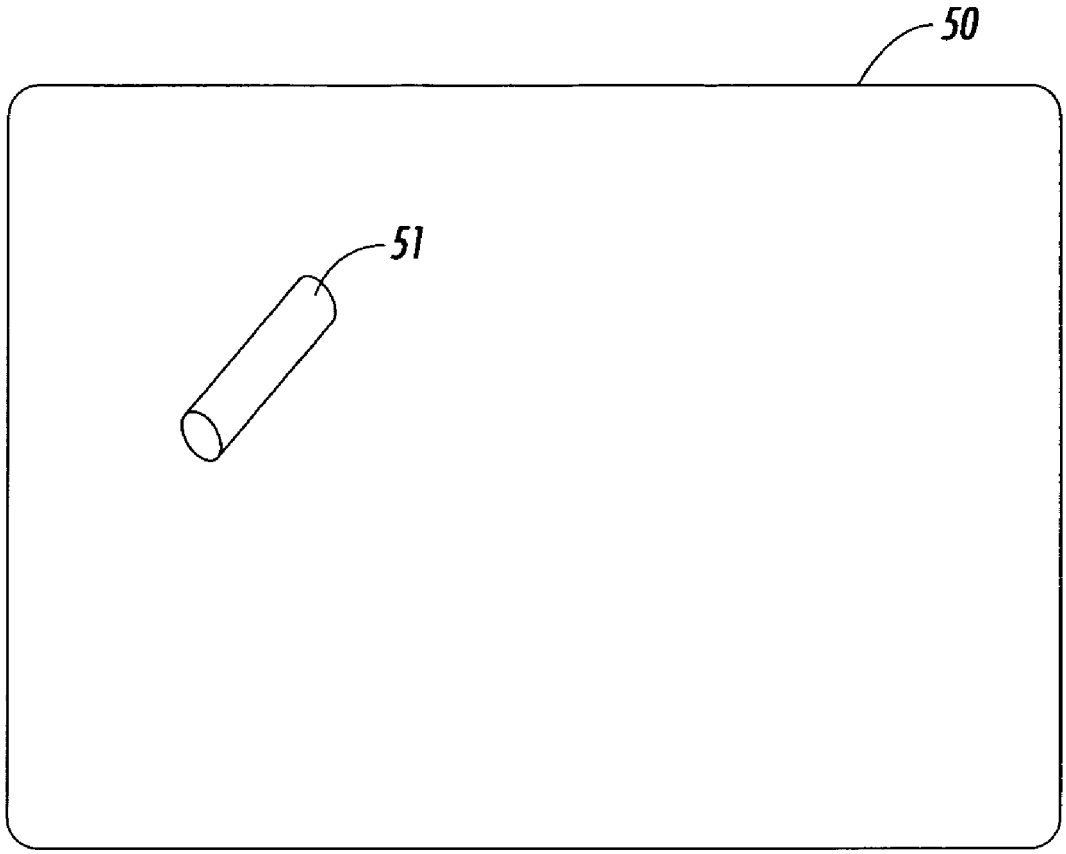
FIG. 8 is a schematic drawing of an exemplary print engine having a fuser roll assembly embodiment of the present invention.

In FIG. 8, an exemplary printer is indicated by box 50. An exemplary fuser roll of the present invention is indicated by roll 51.

Referring again to FIG. 1, rotation of the fuser roll is caused by engagement of teeth 13 of drive gear 11 with drive mechanisms (not shown) that force gear 11 to turn. Sleeve 12 comprises the internal diameter of gear 11 with the result that sleeve 12 is also driven upon engagement of teeth 13. As described above, key 15 engages slot 14 in order that cylinder 10 is driven by drive gear 11. As the fuser roll turns, print substrates are caught in the nip between the fuser roll and the adjoining pressure roll and are pulled and guided over and past the fuser roll. Since the fuser roll is heated to fusing temperature, the result is fusing the toner to the copy substrate by at least partially melting the toner under pressure.

The failure mode of a thin-walled fuser core cylinder with a conventional drive slot is shown in FIG. 1. In this view, cylinder core 10 has a wall thickness substantially less than the standard 5.5 mm thickness. Wall thicknesses from about 0.5 mm to about 2.0 mm result in substantially shorter warm-up times and substantial improvements in energy efficiency. The thinner the wall, the shorter the warm-up and the greater the energy efficiency. P re-heating warm-up times less than about one (1) minute is desirable and less than about 30 seconds is preferred. Testing indicated that a wall thickness of about 1.1 mm was adequate for fuser rolls having an outside diameter of about 35.0 mm. Such fuser rolls are typically used in electrostatographic imaging systems capable of printing more than 50 pages per minute. However, as shown in FIG. 1, cracks developed from the base of keyway slot 14 in as few as 30,000 copies. Expected life for such fuser rolls is intended to last at least 400,000 copies.

Figure 2:
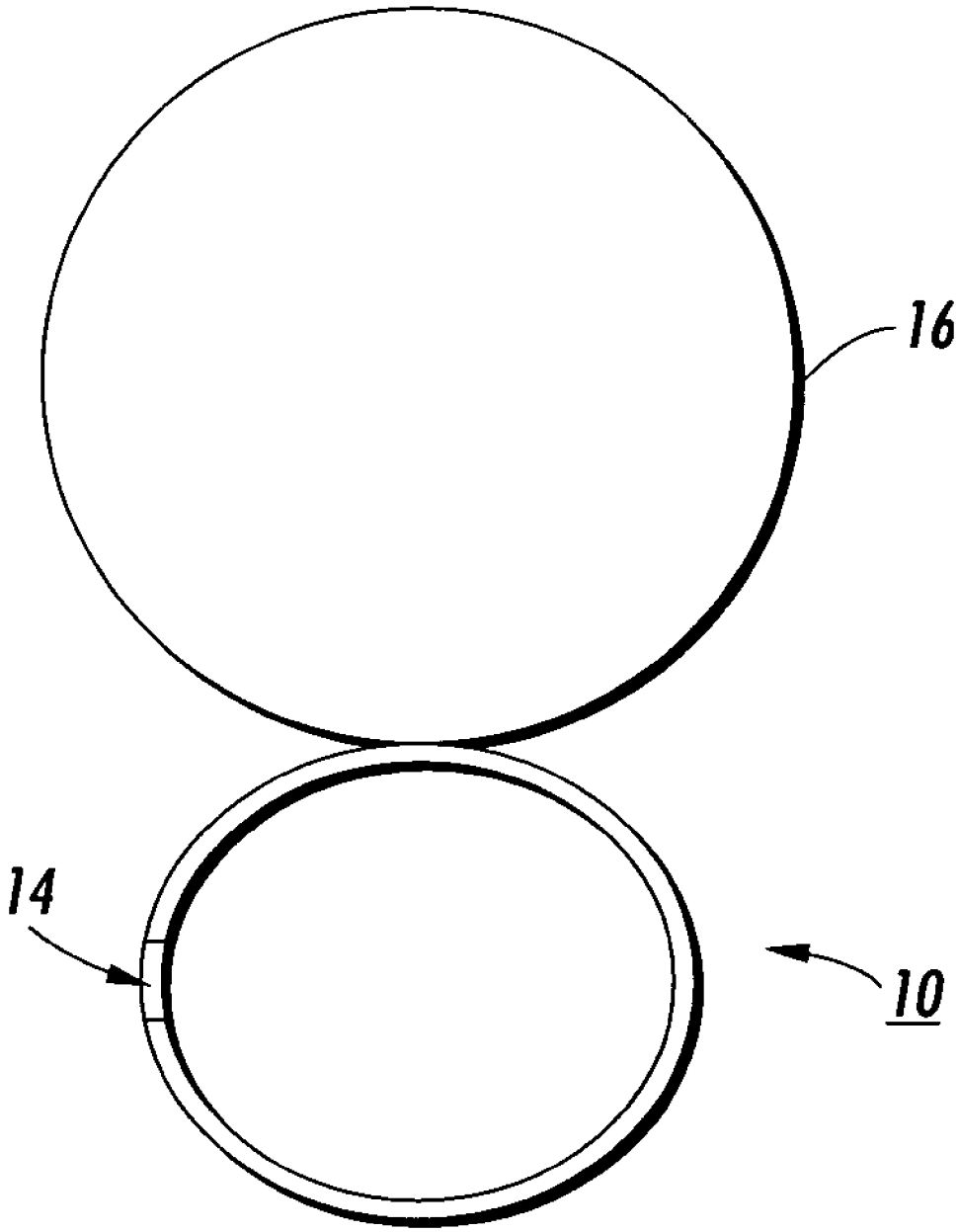
FIG. 2 PRIOR ART
FIG. 2 is a cross-sectional end view of a thin walled fuser roll core cylinder pressed by a pressure roll.

Initial inspection suggested that the cracks developed due to the torque forces imparted by the key upon the thin-walled cylinder. Subsequent investigation revealed, however, that the cracks developed through cyclic compressive force on the roll and especially at the slot location as the roll rotates 90° from the slot into and out of the pressure roll nip. Most of the length of cylinder 10 is sufficiently removed from slot 14 to resist significant cyclic compression during rotation. As shown in FIG. 2, however, the walls do not have sufficient strength in the end region to resist being partially pushed into the width of the slot by pressure roll 16 because through slot 14 removes all support from this end region. The result is that pressure from pressure 16 roll flattens the end regions proximate to slot 14 during periods in which the slot rotates approximately 90° from the nip of the pressure roll. In conventional core cylinders, the thickness of the walls of the core cylinder provides sufficient strength to prevent cyclic compression.

Further analysis revealed that the compression stresses in the region of slot 14 were directed axially along the length of cylinder 10. Such axially-directed stress is shown by arrow 17 in FIG. 1. With this knowledge, efforts commenced to design a fuser roll core cylinder assembly having thin walls and having means for redirecting cyclic hoop stress from axially-directed stress to radially directed stress.

Figure 3:
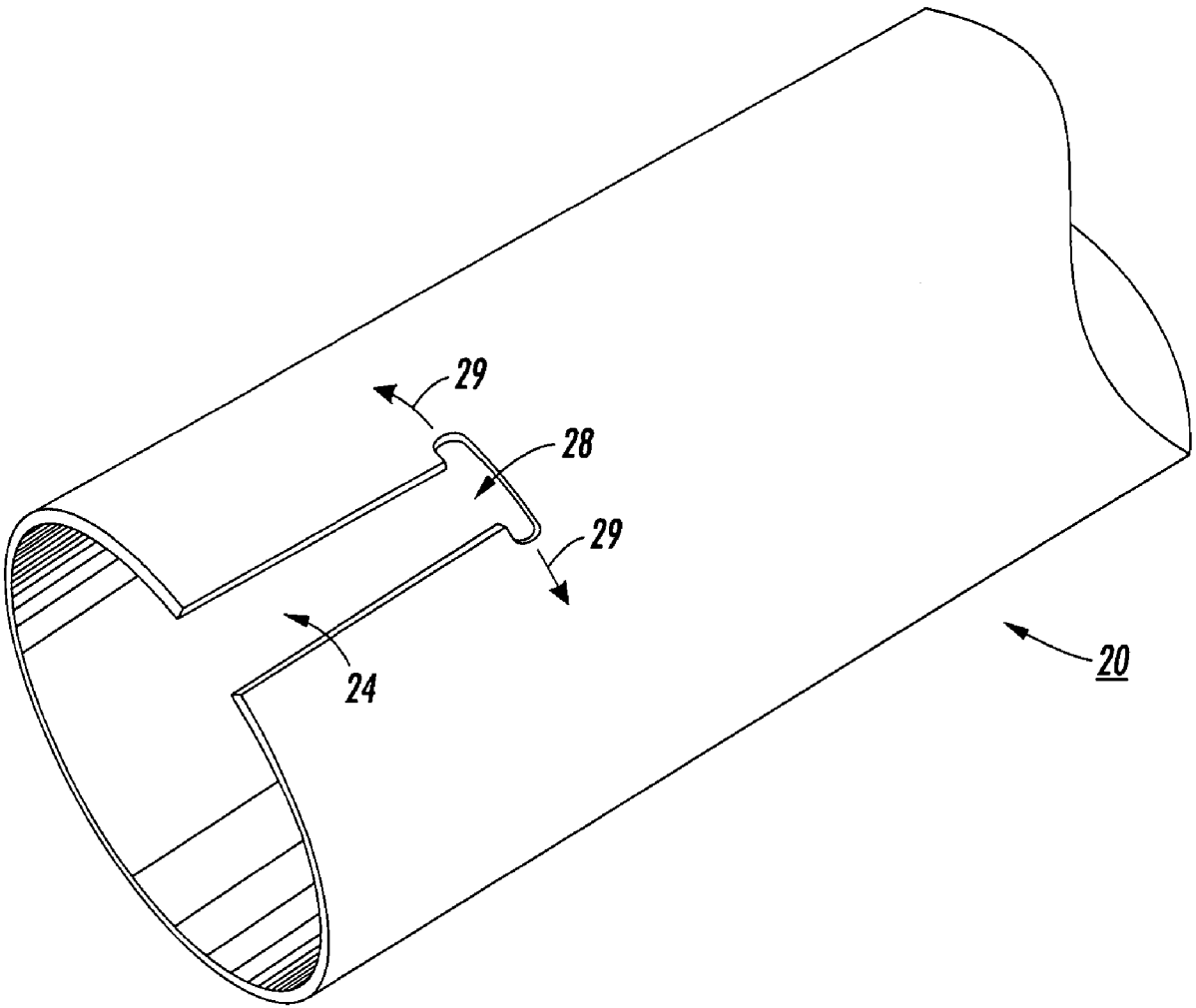
FIG. 3 is a perspective view of a fuser roll core cylinder having a radial slot intersecting the keyway

One solution to redirecting fatigue stress relative to the axial stress concentration areas of a conventional core cylinder keyway slot is shown in FIG. 3. In this embodiment, keyway slot 24 ends in a radial slot 28. The result, as shown by arrows 29, is that fatigue stress during compression is reduced and re-oriented relative to the fuser core cylinder axial pressure stress. This redirection is significant because the grain of the metal of cylinder 10 generally runs axially rather than radially. Situating the grain axially is a preferred practice since the cylinder is formed by bending a sheet of metal, and such bending across the grain inhibits cracking and produces a stronger cylinder. By redirecting the cyclic compression stress along radial arrows 29 rather than along the axial axis of the cylinder, the stress flows across the grain of the metal. Although the end region of cylinder 20 is still flattened during rotation as shown in FIG. 2, cracking such as shown in FIG. 1 is much less likely.

In FIG. 3, keyway 24 of core cylinder 20 is sized to accept key 15 shown in FIG. 1. Core cylinder 20 may accordingly be driven by drive gear 11 in the same manner as cylinder 10 of FIG. 1. Pin 15 may extend into radial groove 28 but preferably exerts its force upon the sides of keyway slot 24. In a manner similar to cylinder 10, cylinder 20 has a wall thickness of only from about 0.5 mm to about 2.0 mm and preferably about 1.1 mm thick. The advantages of fast warm-up time and energy efficiency are accordingly essentially the same as with cylinder 10. Cyclic compression is not eliminated or reduced by the embodiment shown in FIG. 3. Instead, stress is redirected into the radial direction, across the grain, such that cracking is much less likely. Using the embodiment shown in FIG. 3, life expectancies exceeding 400,000 copies are routinely obtained.

Figure 4:
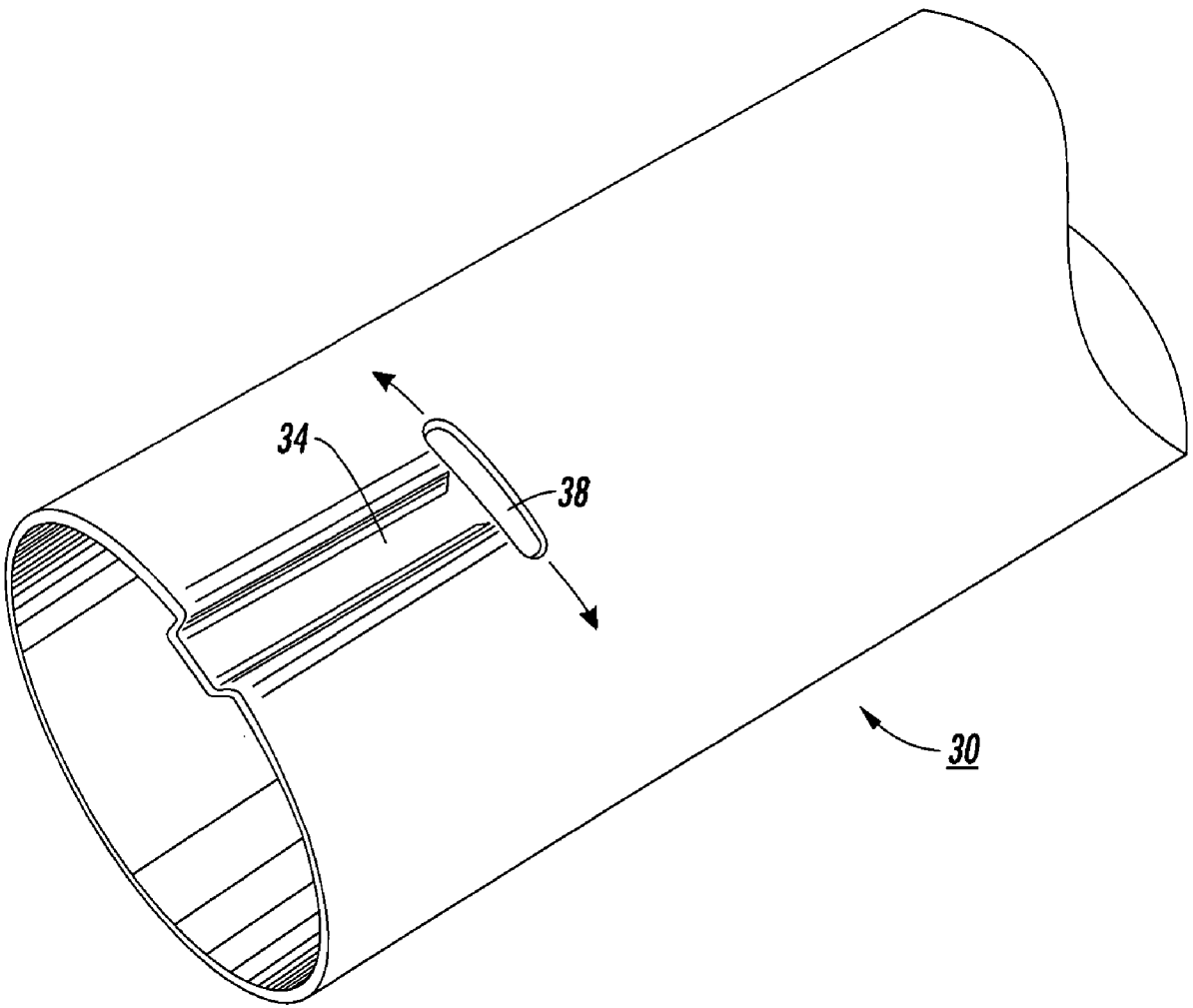
FIG. 4 is a perspective view of a fuser roll core cylinder assembly having a pressed key way groove for added strength and a narrow radial slot.

Another embodiment of a fuser core cylinder in which stress is redirected from the axial direction to the radial direction is shown in FIG. 4. Radial slot 38 is a narrow, elliptical slot that redirects stress into the radial direction. In addition to such stress redirection, cylinder 30 in FIG. 4 exemplifies a means for reducing cyclical compression.

Cylinder 30 is shown with a slotless keyway 34 pressed into the wall of cylinder 30. Keyway 34 is sized to accept key 15 shown in FIG. 1. Core cylinder 30 may accordingly be driven by drive gear 11 in the same manner as cylinder 10 of FIG. 1. Also, thin walls from about 0.5 mm to about 2.0 mm and preferably about 1.1 mm thick are possible with core cylinder 30. However, because keyway 34 replaces slot 14, metal remains in the area previously voided by slot 14. The metal, although deformed by the pressing, provides enough strength to diminish the cyclical compression shown in FIG. 2. When coupled with radial slot 38, whatever cyclical stress occurs is redirected from an axial direction to a radial direction. The result is that cyclical compression is both reduced and then redirected. Cracking such as shown in FIG. 1 is accordingly very unlikely.

As shown in FIGS. 3 and 4, a radial slot to reduce and redirect pressures can take a variety of forms. Such slot may be essentially elliptical, circular, rectangular or have straight sides with rounded ends. The radial slot preferably intersects the axial keyway terminus but it may in fact be located proximate to the terminus but without intersecting the keyway or may intersect the keyway further toward the end of the core cylinder than the terminus. Additionally, the radial slot may be formed without removing material by pressing or other deforming operation.

Figure 5:
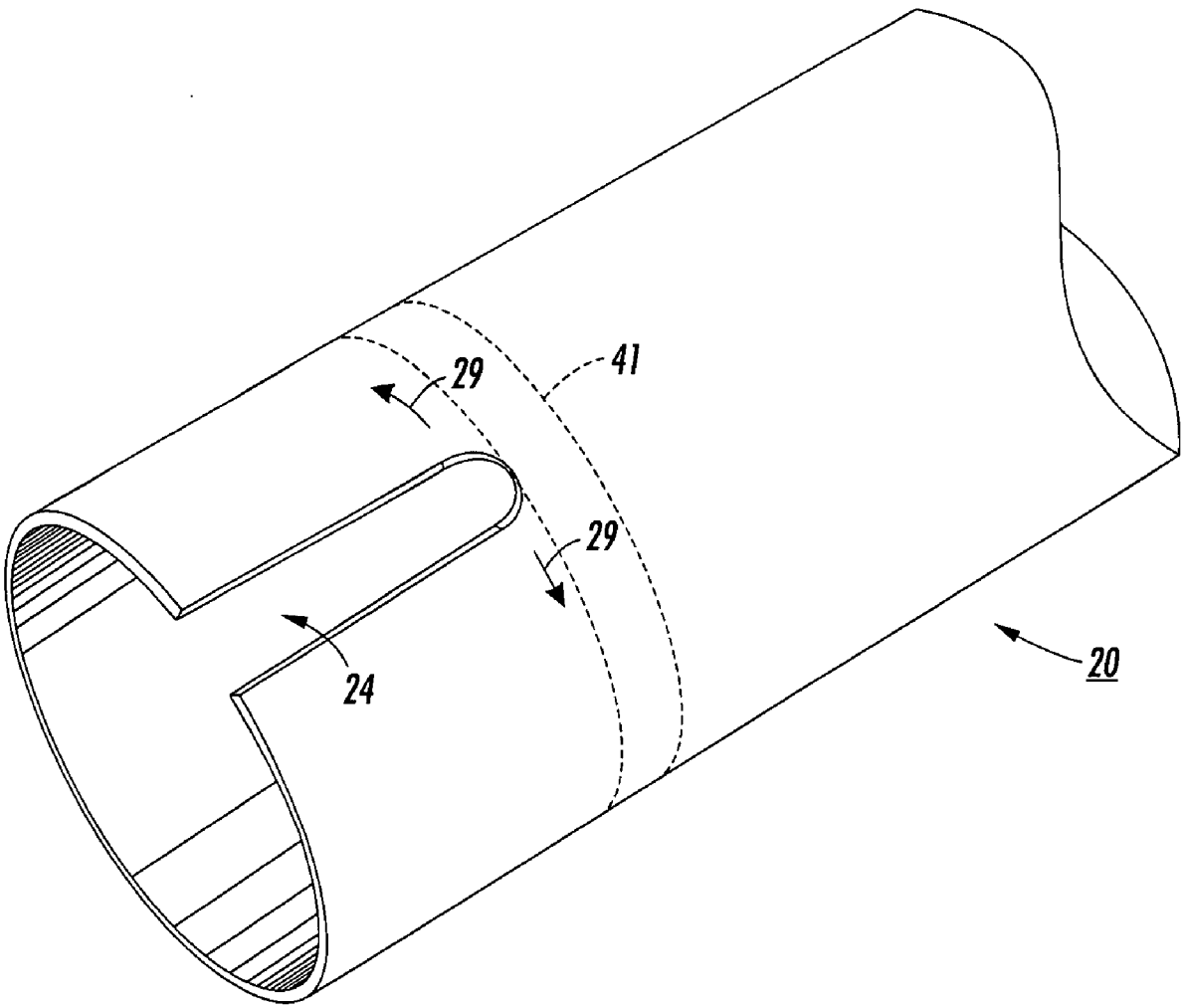
FIG. 5 is a perspective view of a fuser role core cylinder assembly having a ring reinforcement member.
Figure 6:
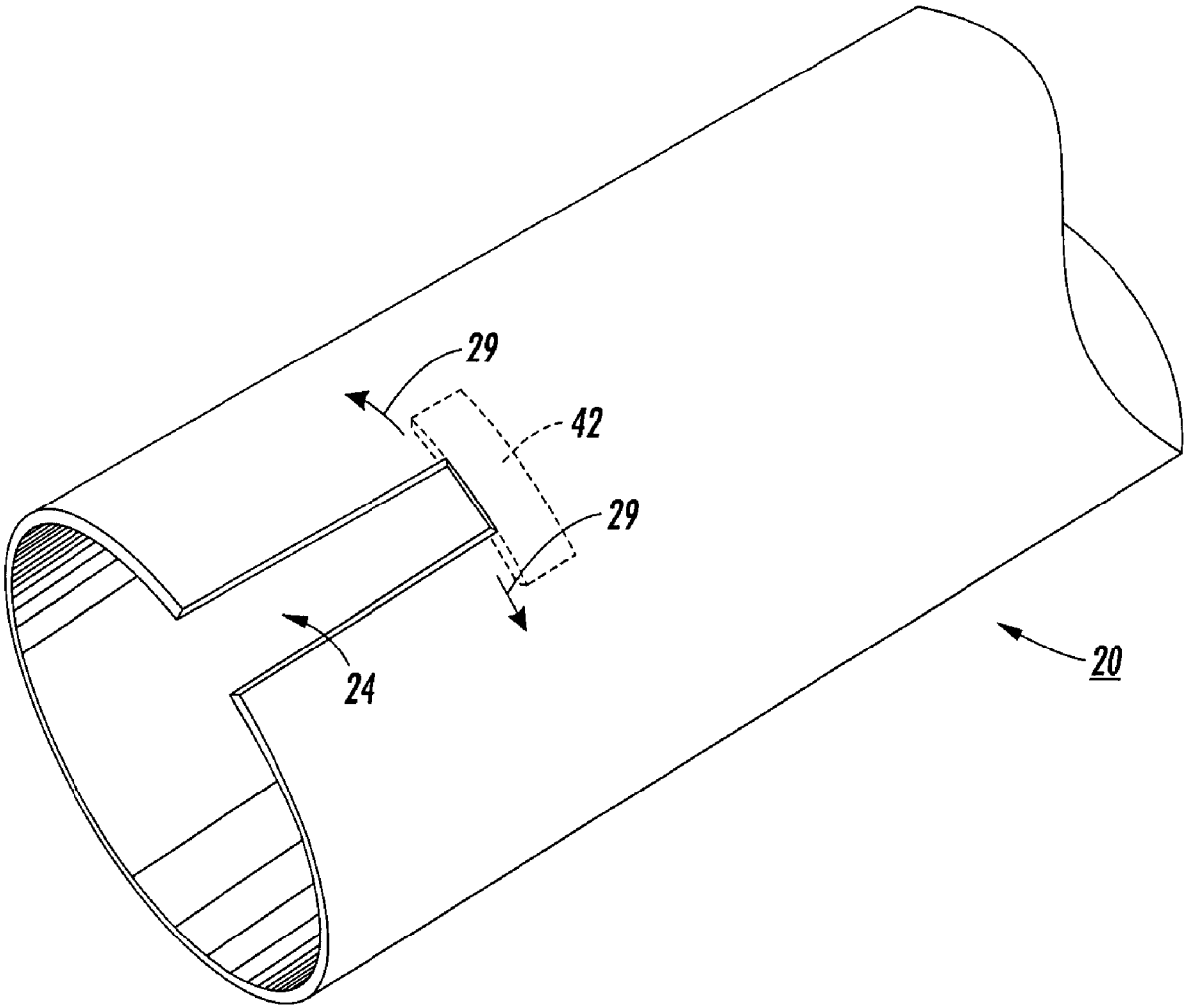
FIG. 6 is a perspective view of a fuser role core cylinder assembly having a segment of a ring reinforcement member.
Figure 7:
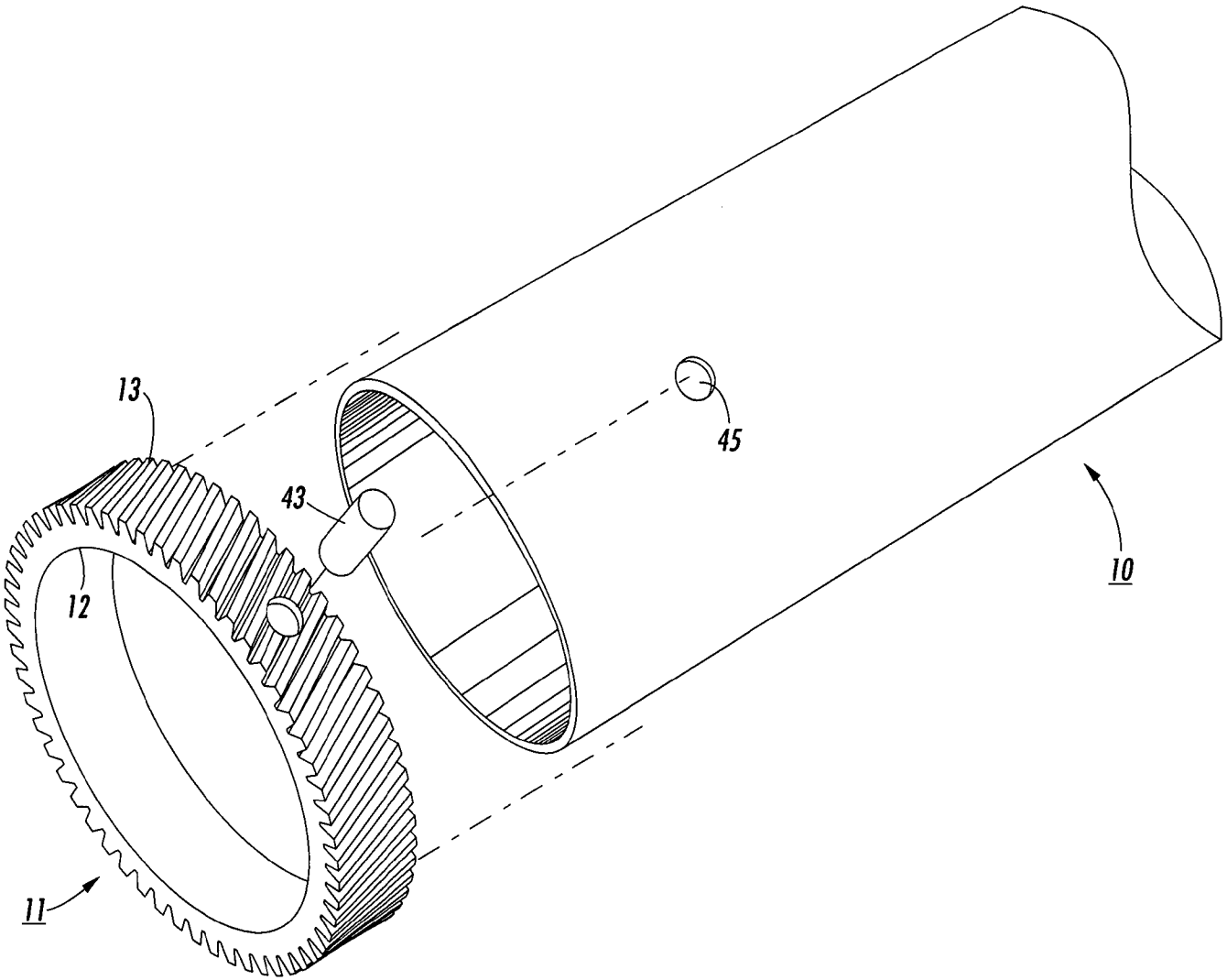
FIG. 7 is a perspective view of a fuser role core cylinder assembly having a hole through which a pin in a gear assembly can be placed.

As indicated by cylinder 30 in FIG. 4, methods of redirecting stress can be augmented by means to strengthen the core cylinder walls over the strength available with a through slot such as slot 14 in FIG. 1. Other embodiments with strengthened walls include cylinders that comprise reinforcement members around slots. Such reinforcement members may take any number of forms, including an internal or external ring as shown by ring 41 in FIG. 5 or a segment of a ring as shown by segment 42 in FIG. 6. Another means for strengthening the walls in the end region of a core cylinder is to replace a slot such as slot 14 in FIG. 1 with a hole 45 as shown in FIG. 7. Instead of a key such as pin 15 shown in FIG. 1, a slidable pin 43 is mounted to sleeve 12. Once the pin is aligned with hole 45, the pin can be pressed into hole 45, thereby enabling a drive gear such as drive gear 11 to drive the core cylinder.

In review, the thin-walled core fuser cylinder assembly of the present invention includes thin walls plus means for redirecting stress caused by cyclical compression from the cylinder's axial axis to the radial axis. When compared to fuser core cylinders in the prior art, the present invention permits faster warm-up times and improved energy efficiency while resisting premature cracking of the core cylinder.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A thin-walled fuser roll core assembly, comprising:

a metallic core cylinder having a wall thickness between about 0.5 millimeters and about 2.0 millimeters, an end region, and having an axial and a radial direction;

a drive gear having an internal diameter sleeve for fitting over an end of the core cylinder and a key for forcing rotation of the core cylinder;

a keyway in the end region of the core cylinder for receiving the drive gear key, said keyway having a terminus;

a means for redirecting axial oriented stress at the terminus of the keyway to a radial direction.

2. The thin-walled fuser roll core assembly of claim 1, wherein the core cylinder has a diameter of about 35 millimeters.

3. The thin-walled fuser roll core assembly of claim 1, wherein the core cylinder has a diameter larger than about 35 millimeters.

4. The thin-walled fuser roll core assembly of claim 1, wherein the wall thickness is between about 0.9 and 1.4 millimeters.

5. The thin-walled fuser roll core assembly of claim 1, wherein the wall thickness is about 1.1 millimeters.

6. The thin-walled fuser roll core assembly of claim 1, wherein the keyway has a terminus opposite from the end of the core cylinder and wherein the redirecting means is a radial slot formed proximate to the terminus of the keyway.

7. The thin-walled fuser roll core assembly of claim 6, wherein the radial slot is essentially circular.

8. The thin-walled fuser roll core assembly of claim 6, wherein the radial slot is essentially elliptical.

9. The thin-walled fuser roll core assembly of claim 6, wherein the radial slot and the keyway terminus are non-intersecting.

10. The thin-walled fuser roll core assembly of claim 1, wherein the radial slot comprises a location of defomed and retained metal.

11. The thin-walled fuser roll core assembly of claim 1, further comprising a means for providing strength to the core cylinder wall proximate to the keyway sufficient to prevent cracking from cyclic compression.

12. The thin-walled fuser roll core assembly of claim 11, wherein the strength means comprises a keyway groove and wherein the key is a pin fixedly protruding from the interior side of the sleeve.

13. The thin-walled fuser roll core assembly of claim 12, wherein the keyway groove is a pressed groove.

14. The thin-walled fuser roll assembly of claim 11, wherein the strength means comprises a reinforcement member mounted proximate to the terminus of the keyway.

15. The thin-walled fuser roll core assembly of claim 14, wherein the reinforcement member is a ring.

16. The thin-walled fuser roll core assembly of claim 14, wherein the reinforcement member comprises a segment of a ring.

17. The thin-walled fuser roll core assembly of claim 11, wherein the strength means comprises walls around a key hole and wherein the key comprises a pushable pin capable of being pushed into the key hole once the pin and the key hole are aligned.

18. An electrostatographic imaging system, comprising:

a thin-walled fuser roll assembly, comprising:

a metallic core cylinder having a wall thickness between about 0.5 millimeters and about 2.0 millimeters, an end region, and having an axial and a radial direction;

a drive gear having an internal diameter sleeve for fitting over an end of the core cylinder and a key for forcing rotation of the core cylinder;

a keyway in the end region of the core cylinder for receiving the drive gear key;

a means for redirecting axial stress to a radial direction.

19. The electrostatographic imaging system of claim 18, wherein the imaging system is an electrophotographic printer.

20. The electrostatographic imaging system of claim 19, wherein the imaging system is capable of printing more than about 50 pages per minute.

21. A process for fusing toner to a copy sheet, comprising:

for a period less than about one (1) minute, pre-heating a thin-walled fuser roll comprising core cylinder walls between about 0.5 millimeters and about 2.0 millimeters thick wherein a redirecting means redirects axial stress at the terminus of an axial keyway formed in the thin walls to a radial direction;

moving a copy sheet into engagement with a nip formed by the fuser roll and a pressure roll; and driving rotation of the fuser roll with a drive gear having an internal diameter sleeve fitting over an end of the core cylinder and a key for engaging the keyway of the core cylinder, thereby moving the paper through the nip.

22. The process of claim 21, wherein the pre-heating is less than about 30 seconds.

* * * * *